United States Patent [19]

Turbitt et al.

[11] Patent Number: 4,554,066

[45] Date of Patent: Nov. 19, 1985

[54] DENSITY CLASSIFICATION OF PARTICULATE MATERIALS BY ELUTRIATION METHODS AND APPARATUS

[76] Inventors: David M. Turbitt, Apt. #3, 141 King St., East; James F. Archibald, 12 Glenwood Ct., both of Kingston, Ontario, Canada

[21] Appl. No.: 568,093

[22] Filed: Jan. 4, 1984

[51] Int. Cl.[4] ..... B03B 7/00

[52] U.S. Cl. ..... 209/3; 209/17; 209/159

[58] Field of Search ..... 209/2, 3, 17, 158–161

[56] References Cited

U.S. PATENT DOCUMENTS

| | | | |
|---|---|---|---|
| 801,200 | 10/1905 | Bailey | 209/17 |
| 1,591,420 | 7/1926 | Garcia | 209/17 |
| 2,429,436 | 10/1947 | Walker | 209/17 |
| 2,760,634 | 8/1956 | Saxe | 209/158 |
| 3,700,849 | 10/1972 | Zuzelo | 209/3 |
| 4,430,209 | 2/1984 | Merck et al. | 209/17 |

FOREIGN PATENT DOCUMENTS

| | | | |
|---|---|---|---|
| 102673 | 12/1906 | Canada . | |
| 373828 | 5/1938 | Canada . | |
| 489047 | 12/1952 | Canada | 209/159 |
| 293734 | 12/1929 | Fed. Rep. of Germany | 209/160 |
| 451942 | 8/1936 | United Kingdom | 209/159 |
| 171821 | 7/1965 | U.S.S.R. | 209/160 |

*Primary Examiner*—David L. Lacey

*Attorney, Agent, or Firm*—Sixbey, Friedman & Leedom

[57] ABSTRACT

This specification relates to a counter-flow sedimentation separator which is designed to separate mixed aggregate materials on either side of a preset cutoff density and to a method of separating such materials. The separator has been designed primarily to highgrade gold tailings but can be used to perform a similar function with other materials given an adequate difference in density between the materials to be separated. It employs a multi-column design which coupled with screening allows density separations to be completed throughout the usual spectrum of particle sizes found in tailings and can be modified according to the material to be processed in order to maximize efficiency.

9 Claims, 3 Drawing Figures

DENSITY CLASSIFICATION OF PARTICULATE MATERIALS BY ELUTRIATION METHODS AND APPARATUS

This invention relates to a process and apparatus particularly applicable to the mining industry by which particles are separated according to density.

BACKGROUND OF THE INVENTION

Typically gold ore is composed of up to a few ounces of gold per ton of host medium. Gold has a density of about 17 gm/cm$^3$, and silica, a typical host medium, has a density of about 3 gm/cm$^3$. Traditionally gold ore has been crushed into fine particles in a mill, then a cyanide leaching process is used to chemically remove the gold contained in the crushed ore. Once the gold is removed the crushed ore or tailings (as they are now called) are disposed of. Invariably this method is inefficient in that not all the gold is removed. The primary reason for this inefficiency lies in the fact that not all the gold is exposed to the leaching action due to inadequate crushing. This inadequate crushing is due to interference caused by the smaller particles protecting the larger particles which require further crushing.

Forms of an elutriation technique have been in use in laboratories for decades where particles are sorted according to diameter, as in a "Cyclo-sizer" (Trademark of Warman International).

The other major form of density separation previously used employed a stationary high density slurry into which material to be separated was simply dropped then vibrated. This batch method of density separation has proven to be too slow and expensive to be used on a large scale.

Two Canadian patents of interest relating to the use of fluids to separate mixed materials are Canadian Patent No. 102,673 of Trottier issued Dec. 18, 1906 and Canadian Patent No. 373,878 of Remick issued May 17, 1938. The Trottier reference describes and illustrates a single column apparatus for separating at different levels in the column material of constant size but of different density. The column contains a plurality of vertically spaced sorting tables and collection vanes which act to sort materials according to density and permit higher density materials to fall while lighter density materials are drawn off at appropriate heights within the column down-shoots. The Remick patent describes an apparatus and process for separating low density materials such as coal from a higher density host material such as slate. The mixed materials are introduced to a tank provided with an upwardly flowing current of water which carries particles of lesser specific gravity, such as coal, upwardly and out of the upper end of the tank onto an overflow wier, where they are collected on a screen. Again the Remick apparatus is inefficient over a large range of particle sizes.

The object of the invention is to apply a unique, controlled, combined elutriation screening technique to density separations, particularly applicable to gold and diamond tailings in order to economically recover previously unavailable valuable materials.

SUMMARY OF THE INVENTION

According to the present invention, there is provided a counter-flow sedimentation separator and process designed to separate mixed aggregate materials by density fractioning.

The invention embodies a process which utilizes both the classifying effect of a column of fluid, such as water, flowing vertically and standard size screening techniques used in an alternating sequence. This process begins by introducing the particulate material, to be separated, into an upward flowing column of water known as an elutriation column. The rate of flow of the water will depend on the size and density characteristics of the particles to be separated, but a velocity of about 20 cm/s would be typical. The high density underflow is retained, and the low density (or smaller size) overflow is introduced into the next lower velocity classifying flow which allows smaller high density particles to settle out. The underflow is screened, such that the material which is underflow due only to its relatively large size becomes the discarded oversize, the undersize being of high density is retained. The overflow from this second classifying column is introduced into the next elutriation column which again has a lower flow rate, and the underflow is subjected to a screening process with a smaller mesh size. Again it is the undersized underflow which is retained and the overflow continues to be introduced to lower velocity flows and finer mesh screening processes as described until the overflow is so fine that it is believed to contain very little gold.

The invention also embodies an apparatus consisting of a series of elutriation columns with decreasing flow rates and increasing column diameters such that the overflow from each column is introduced into the next column of the series. This apparatus employs a constant feed and can effect separations at a high rate with little expense. In a preferred embodiment, the apparatus is further designed to introduce the material to be separated into a cyclone mixing chamber in order to break up any large lumps of tailings which might erroneously become underflow if not broken into particulate components.

This apparatus according to the present invention allows large quantities of tailings to be processed and highgraded. The highgraded tails can then be returned to the extraction plant where more gold can be extracted using traditional techniques. In order to effect the separation across the spectrum of particle sizes, multiple elutriation columns are coupled with screening techniques such that the retained material is both underflow in the elutriation column and undersize with respect to the screening process.

BRIEF DESCRIPTION OF THE DRAWINGS

In drawings which illustrate example embodiments of the invention.

While the invention will be described in conjunction with an example embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE INVENTION

The elutriation process described here refers to a type of dynamic counter-flow sedimentation in which the separation medium (liquid) is moved rather than the solid matter to be separated. Aggregate materials and tailings materials of restricted size ranges, generally less than 20 mesh, are ideally suited for elutriator separation. The purpose of the design is to fabricate a heavy density concentrate (underflow material) from a mixed aggregate material; the lighter density waste material is swept away by the upward flow of a separation medium such as water or air while the heavy density valuable material is allowed to fall into an entrapment chamber for collection.

Theoretically, a particle of diameter "d" and density "$\rho_s$", will fall at a velocity "v" through any liquid of density "$\rho_l$" and viscosity "$\eta$", as indicated by the equation:

$$v=[d^2g(\rho_s-\rho_l)]/18\eta$$

where "g" is the acceleration due to gravity. In an elutriation process, the variable "v" is used to set the flow rate of the liquid column such that particles of a required density "$\rho_s$" and diameter "d" will be at terminal velocity within the liquid and thus suspended. Particles of greater diameter or density will drop to the bottom as underflow and particles of a lesser size or density will be washed away by the fluid column, as overflow. Thus this system can be used to separate particles varying in size or density.

One probable use of the present invention would be to separate industrial grade diamonds from their host material as present separation techniques often miss many of the smaller diamonds which are still of value in industrial applications. The apparatus and process discussed here with respect to gold tailings would most likely require somewhat higher flow rate (up to several meters per second) and slightly larger mesh screening operations based on the different size and density characteristics of diamond tailings.

Figure 1:
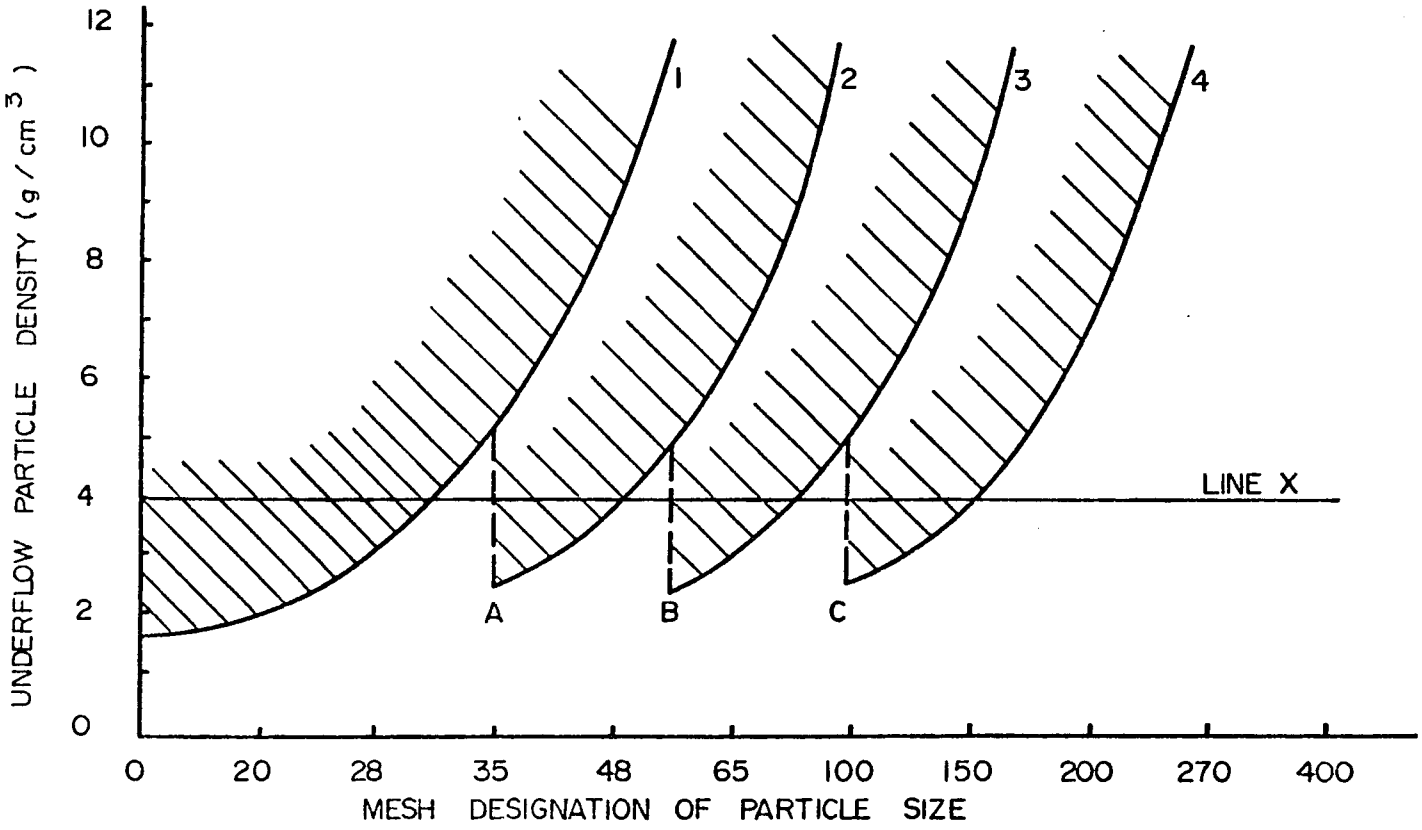
FIG. 1 is a graph illustrating typical theoretical design considerations used to set flow rates, decide how many columns should be employed, and decide where screening procedures should be employed in the apparatus and process of the present invention.

Turning to FIG. 1, ideally line "X" represents the optimum separation cutoff line. This line is set just higher than the true solids density of the tails, thus only host material containing other higher density elements will settle out. In practice, however, separations as along line "X" must be approximated as indicated by the shaded area above lines 1 through 4 where the areas above lines 1 through 4 depict the product placement characteristics of the underflow for each column in a series of four. The dashed lines, "A", "B", and "C" indicate where screening processes are employed such that the oversize is discarded, and the undersize which is to the right of these lines is retained for reprocessing. Thus the entire shaded area in FIG. 1 represents the size density characteristics of the particles which will be retained. The curved lines 1, through 4, are calculated as based on the previously stated equation such that flow rate "v" is set and the density of particles of a given size is calculated. Decreasing the flow rate has the effect of broadening the range of the curve. All the curves asymptotically approach the density of the separation medium itself. Thus as can be seen in FIG. 1, the curves can be broadened to the right by decreasing the flow such that at zero flow the parabola is flattened into a straight line along the density of the separation medium. Similarly the vertical lines representing the screening process can be adjusted in order to optimize efficiency.

The number of stages to be used is also an important consideration. The greater the number of stages the greater the efficiency of the apparatus as a whole, however, as the overflow from each column is introduced to the subsequent column, the inflow volume increases rapidly from one column to the next. Very quickly size considerations limit the number of stages to be used.

In the actual portion of the apparatus where the separations are being made, the ideal flow pattern is that of plug flow, (ie. the exact design velocity across the entire cross-section of the separation column) however in practice this must be approximated due to the finite viscosity of the separation medium. Thus the higher the Reynold's number describing the flow in the column the more accurate the separation, and thus the greater efficiency of the apparatus as a whole. Maximizing the Reynold's number must however be weighed against restrictions of physical size. This problem becomes especially critical when dealing with the lower flow rates. However as it is improbable that the traditional leaching process would erroneously miss much of the gold associated with minus 270 mesh particles, separations this low in the spectrum need not be carried out. Further, this lack of gold associated with the very fine particles allows desliming of the slurry before it is introduced to the first mixing chamber without adversely affecting column efficiency. This desliming process is useful in that it removes the fines and thus inhibits larger conglomerate particles forming as these particles would be mistakenly retained.

Figure 2:
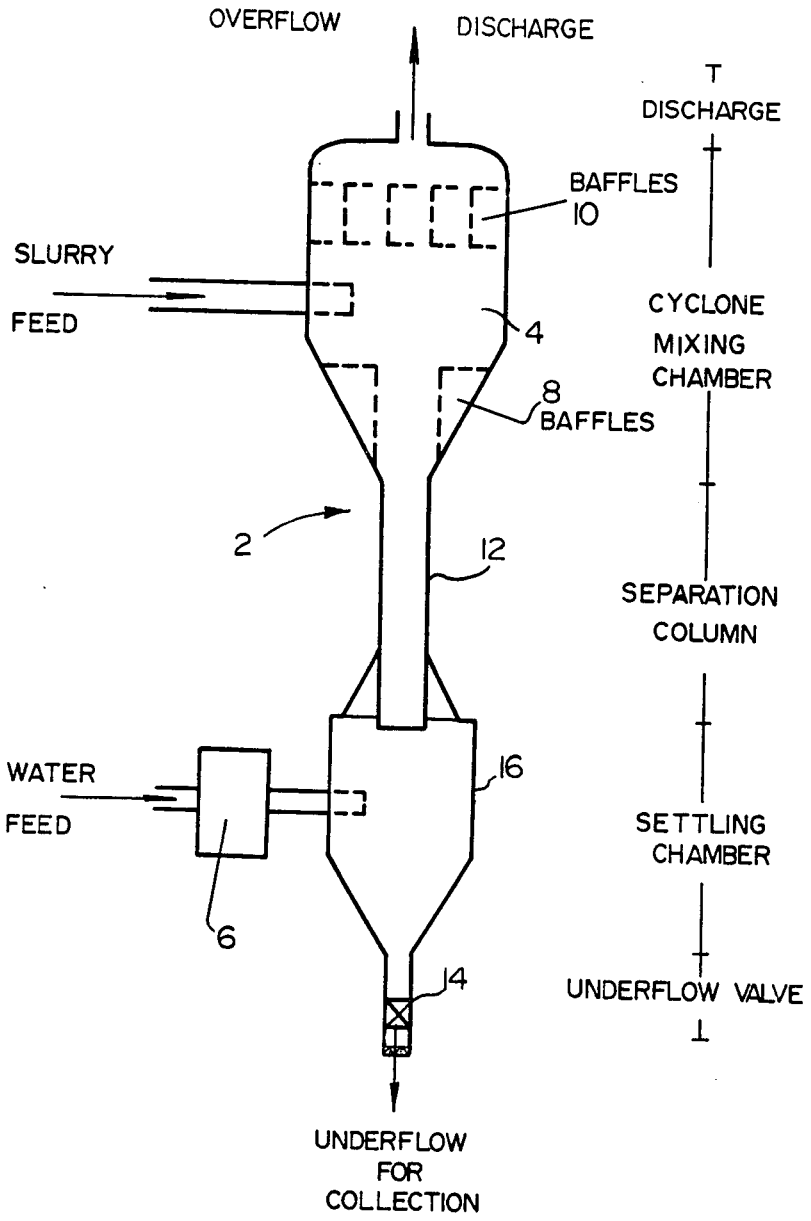
FIG. 2 is a cross-sectional schematic view of a typical elutriation column of an example apparatus according to the present invention.

FIG. 2 is a schematic representation of a typical apparatus where the overflow from each column enters the mixing chamber 4 of the next column 2. Each successive column 2 also has a lower flow rate produced by water pump 6 to allow finer particles as underflow. Water from pump 6 enters each column 2 through settling chamber 16, below each elutriation column 12. Generally the system would be set to concentrate the desired element by a factor of about 100, but this can be altered.

In a further effort to break down large particles in the mixing chamber 4 the slurry is introduced such that it will cause a cyclone effect in the mixing chamber. The lower set of baffles 8 prevent these currents from interfering with the elutriation action. The upper set of baffles 10 again reduce the turbulence in the upper part of the mixing chamber 4. This allows particles which should have become underflow, but were caught up in the turbulence of the mixing chamber, to settle back down to the elutriation column 12.

Figure 3:
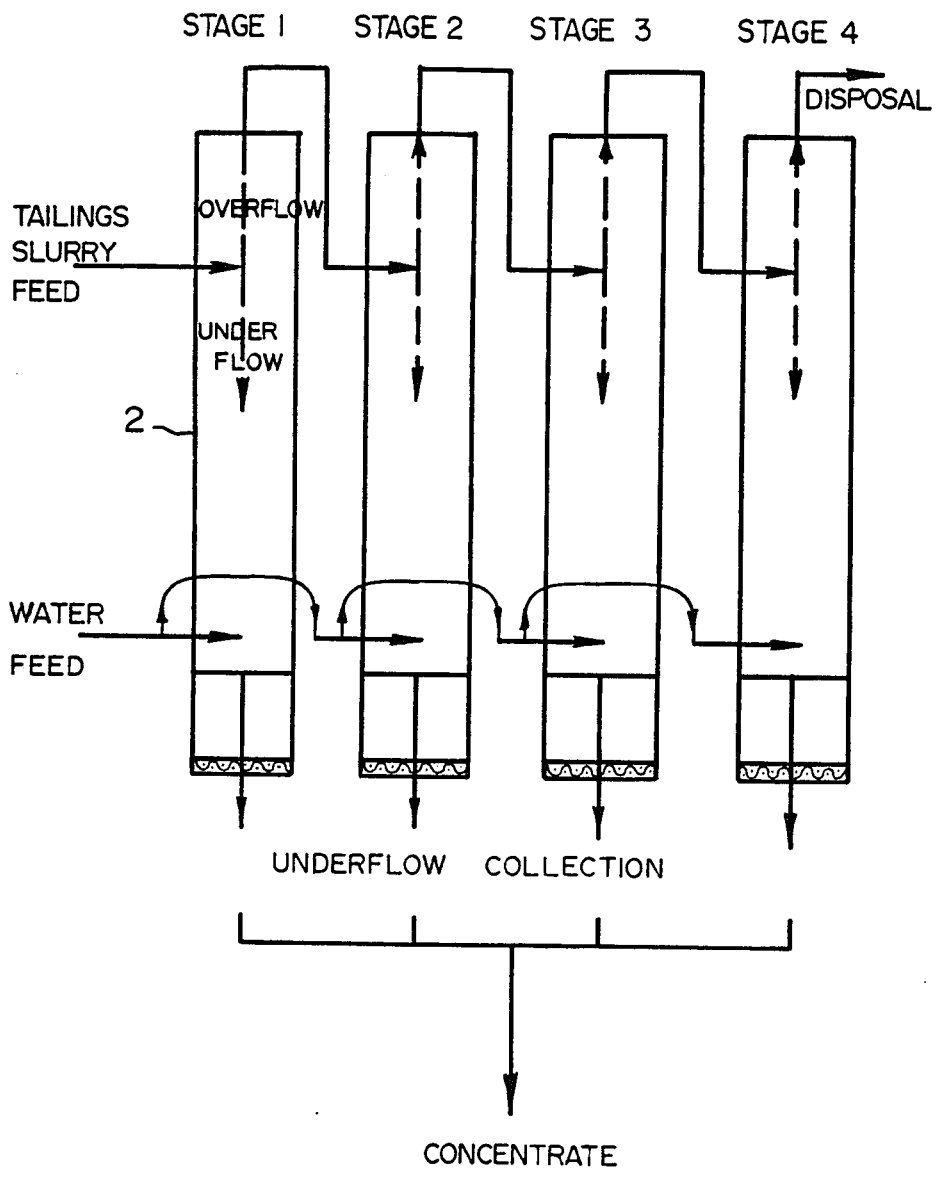
FIG. 3 is a schematic representation of an example four-stage elutriation process according to the present invention.

The apparatus represented in FIG. 3 comprises four separate columns 2 like those in FIG. 2 such that the overflow of each column is introduced to the mixing chamber of the next column in the series. The underflow to be screened is removed from the underflow valve 14, at the bottom of settling chamber 16 below each elutriation column 12.

As an alternative, the process may be carried out essentially in reverse, that is, using a series of screening procedures, then making individual counter-flow sedimentation density separations on the individual size fractions from each screening procedure.

Typically the process of the invention as applied to gold ore recovery employs 3 to 8 elutriation columns with flow rates in the range of 100 to 0.3 cm/sec., as well as 2 to 7 screening operations usually between the 20 to 270 mesh sizes. (For diamond tailings, the flow rates of the columns would be in the range of 1000 to 1 cm/sec.). Further, as the density difference between diamonds and host material is often relatively small, additional columns (perhaps up to ten) will be required to achieve adequate separation efficiency. Possibly the optimum approach would embody an initial screening process to separate the tailings into various size fractions, which could then be introduced into separate apparatus, with the flow rates appropriate to that portion of the tailings. An example apparatus of this type designed to process 100 tons of gold tailings per hour would be comprised of four steel columns standing side-by-side, each about 10 m in height and up to two meters in diameter. A system of these dimensions would require a water supply with a capacity of about 2500 l/min and a head of around 15 meters. This new apparatus allows the economical recovery of quantities of gold or other appropriate materials which until this time have been hidden in worthless tailings.

The previously described apparatus could also be used to highgrade material other than gold, given that the required material be of a different density than its host material. FIG. 1 graphically represents a majority of the design considerations pertinent to this apparatus. As stated earlier the horizontal straight line labelled "X" represents the ideal point at which the desired separation is to be made. The elutriation highgrader could also be incorporated in a standard extraction procedure on the ore itself rather than just the tails. Finally in order to highgrade by a very large factor, large quantities of underflow (after standard screening) could be re-introduced to the apparatus. In association with this system, a system for pumping and recycling the separation medium, and a slurry feed system will also be required, however the nature and design of these systems are obvious to a person skilled in the art.

The single elutriation technique has been employed in the past to effect classifications based on particle size with a great deal of success as the terminal velocity of a particle falling through a liquid varies directly with the square of the particle diameter. Further, as most aggregate materials are of very consistent density, accurate size separations by elutriation are quite simple. The apparatus and process according to the present invention are unique in that they perform separations based on particle density with little regard to particle size. This system should prove to be economically successful as the tailings which are to be concentrated are abundant, pre-crushed, above-ground (and thus far more accessible than ore), and can have considerable concentrations of residual gold especially if the tailings were processed years ago when the cyanide leaching process was less refined. Furthermore, as water will probably be the most common separation medium, the environmental and health problems associated with the leaching processes used in gold extraction can be minimized.

Thus it is apparent that there has been provided in accordance with the invention counter-flow sedimentation separator that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What we claim as our invention:

1. A process for separating desired particulate high density materials from associated particulate lower density materials, comprising passing the particulate high and lower density materials through a series of elutriation columns through which an appropriate medium flows to produce underflow and overflow, with the overflow from each column being introduced to the next elutriation column in the series, the flow rate of the medium in each column being substantially plug flow and a decrease from that of the previous column and selected to have desired materials of decreasing size being contained in the underflow from each column.

2. A process according to claim 1 wherein the underflow from each column is screened in a screening step, the screen mesh sizes employed being progressively smaller through the series and being selected according to the flow rate from the elutriation column from which the underflow passed, and wherein the desired material is the undersize from each screening step.

3. A process according to claim 2 wherein sufficient elutriation columns are used to concentrate the desired material by a factor of about 100.

4. A process according to claim 1 or 2 where the high and lower density materials are screened before passing to the series of elutriation columns, and wherein the elutriation flow rates are selected according to the size fraction resulting from each screening step.

5. A process according to claim 4 wherein screening of the particulate high and lower density materials is accomplished before such materials are passed into each elutriation column.

6. A process according to claim 5 wherein each size fraction is introduced for elutriation to one of said columns with an appropriate flow rate, each underflow being the desired high density material.

7. A process according to claim 1 wherein the desired material is gold, and wherein the flow rate of each column is selected from a rate in the range from 0.3 to 100 cm/sec.

8. A process according to claim 1 wherein the desired materials are diamonds, and wherein the flow rate of each column is selected from a rate in the range from 1 to 1000 cm/sec.

9. A process according to claim 1 wherein the particulate high and lower density materials are passed into a cyclone mixing chamber above each elutriation column and in flow communication therewith to assist in breaking down large sized materials.

* * * * *